US009171507B2

(12) United States Patent
Lin et al.

(10) Patent No.: US 9,171,507 B2
(45) Date of Patent: Oct. 27, 2015

(54) CONTROLLER FOR UPDATING PIXELS IN AN ELECTRONIC PAPER DISPLAY

(75) Inventors: Hua Lin, Fremont, CA (US); Xudong Mike Cui, Fremont, CA (US)

(73) Assignee: MARVELL WORLD TRADE LTD. (BB)

( * ) Notice: Subject to any disclaimer, the term of this patent is extended or adjusted under 35 U.S.C. 154(b) by 682 days.

(21) Appl. No.: 13/183,676

(22) Filed: Jul. 15, 2011

(65) Prior Publication Data

US 2012/0013580 A1 Jan. 19, 2012

Related U.S. Application Data

(60) Provisional application No. 61/365,228, filed on Jul. 16, 2010.

(51) Int. Cl.
*G09G 5/00* (2006.01)
*G09G 3/34* (2006.01)

(52) U.S. Cl.
CPC ..... *G09G 3/344* (2013.01); *G09G 2310/04* (2013.01)

(58) Field of Classification Search
None
See application file for complete search history.

(56) References Cited

U.S. PATENT DOCUMENTS

2003/0200057 A1* 10/2003 Johnson et al. ..... 702/184
2005/0001812 A1 1/2005 Amundson et al.
2005/0024353 A1 2/2005 Amundson et al.
2005/0219184 A1 10/2005 Zehner et al.
2006/0139310 A1 6/2006 Zehner et al.
2006/0139311 A1 6/2006 Zehner et al.
2006/0232531 A1 10/2006 Amundson et al.
2007/0205978 A1* 9/2007 Zhou et al. ..... 345/107
2008/0143700 A1* 6/2008 Shin et al. ..... 345/208
2008/0309636 A1 12/2008 Feng et al.
2009/0040201 A1* 2/2009 Kim et al. ..... 345/204
2009/0179923 A1 7/2009 Amundson et al.
2009/0267969 A1 10/2009 Sakamoto
2010/0149158 A1 6/2010 Lee
2010/0220121 A1 9/2010 Zehner et al.
2010/0220122 A1 9/2010 Zehner et al.
2011/0080418 A1* 4/2011 Rhodes ..... 345/522
2011/0216104 A1* 9/2011 Chan et al. ..... 345/690

FOREIGN PATENT DOCUMENTS

WO 2005/101362 A1 10/2005
WO 2008/153216 A1 6/2008

OTHER PUBLICATIONS

Patent Cooperation Treaty (PCT) International Search Report and Written Opinion from co-pending PCT International Patent Application No. PCT/US2011/044130 (International Filing Date Jul. 15, 2011) having a date of mailing of Sep. 28, 2011 (10 pgs).

* cited by examiner

*Primary Examiner* — Christopher R Lamb

(57) ABSTRACT

Systems, methods, and other embodiments associated with controlling pixels of a display are described. According to one embodiment, an apparatus includes a frame counter logic configured to maintain a global frame counter to track a number of refreshes of a display while updating pixels. The frame counter logic is also configured to determine a frame number when updating a pixel. The apparatus also includes a pixel logic configured to update the pixel.

15 Claims, 6 Drawing Sheets

CONTROLLER FOR UPDATING PIXELS IN AN ELECTRONIC PAPER DISPLAY

CROSS REFERENCE TO RELATED APPLICATIONS

The present disclosure claims the benefit of U.S. provisional application Ser. No. 61/365,228 filed on Jul. 16, 2010 which is hereby wholly incorporated by reference.

BACKGROUND

Electronic paper displays, also known as e-paper or electronic ink displays, are a type of electronic display often used in electronic reading devices such as ebooks. Electronic paper displays are stateful, meaning they can display an image without constantly using power, unlike many conventional displays (e.g. LCD displays). Electronic paper displays differ from conventional displays in the way they update a displayed image. For example, electronic paper displays progressively change the value of pixels in the display from a starting value to a final value through intermediate values when switching between displayed images.

Even different electronic paper displays update displayed images in different ways. Some conventional electronic paper displays update all pixels in the display concurrently in a global update. When updating the pixels concurrently, if a new value for a pixel is received during the update, the new value is not reflected in the current update sequence. Instead, the pixel is updated after a second global update that must wait until after the first update is finished. This limits the display's ability to change images quickly.

Other conventional displays update on a per pixel basis, however, these displays use individual counters for each pixel in the display. Maintaining counters for each pixel is cumbersome and consumes a large amount of memory bandwidth since every incremental update of a pixel uses a memory read and write-back to the pixel's counter.

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

SUMMARY

In one embodiment, an apparatus includes a frame counter logic configured to maintain a global frame counter to track a number of refreshes of a display while updating pixels. The frame counter logic is also configured to determine a frame number when updating a pixel. The frame number is based on a current value of the global frame counter and an initial value of the global frame counter. The apparatus also includes a pixel logic configured to update the pixel. The pixel logic updates the pixel based, at least in part, on the frame number for the current value of the global frame counter until the value is equal to a new value.

In one embodiment, the global frame counter is a timer that is based on a refresh rate of the display, a maximum value of the global frame counter is a maximum number of values in a pixel update sequence, and the frame counter logic resets the global frame counter after the global frame counter reaches the maximum value.

In one embodiment, the global frame counter is a timer that is incremented once per refresh of the display.

In another embodiment, a method includes updating a value of a pixel of a display to a new value by: determining an incremental frame number from a current value of a global frame counter; and adjusting the value of the pixel based, at least in part, on the incremental frame number.

In one embodiment, the value of the pixel is updated without performing a write-back of the incremental frame number to a memory.

In one embodiment, determining the incremental frame number includes manipulating the current value of the global frame counter based, at least in part, on an initial value of the global frame counter.

In one embodiment, determining the incremental frame number and incrementally adjusting the value of the pixel occurs iteratively until the value of the pixel equals the new value.

In one embodiment, incrementally adjusting the value of the pixel includes retrieving an intermediate pixel value from a lookup table based, at least in part, on the incremental frame number and the new value, and applying the incremental pixel value to the pixel in the display.

In one embodiment, an apparatus includes a display controller configured to update a pixel in an electronic paper display. The controller is configured to store, in a memory, an indication of a start time for a request to update the pixel. The controller is also configured to determine an incremental frame number by determining a number of refreshes for the electronic paper display since receiving the request to update the pixel to a new value. The controller is further configured to adjust a value of the pixel based, at least in part, on the incremental frame number.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

DETAILED DESCRIPTION

Described herein are examples of methods, apparatus, and other embodiments associated with updating pixels in an electronic paper display. In one embodiment, pixels are updated by using a global frame counter to track incremental frames in an update sequence. Updating pixels with the global frame counter instead of individual counters reduces consumption of memory bandwidth.

In conventional methods that use individual counters, memory is quickly consumed with multiple read and write-back operations to update the individual counters. These multiple memory write-backs are avoided when using a global frame counter by referencing the global frame counter to determine incremental frames for the update sequence instead of performing the memory write-backs. The global frame counter may be maintained as a free running counter that is incremented when the display refreshes. This can result in more efficient use of memory bandwidth while providing greater flexibility to individually update pixels.

Figure 1:
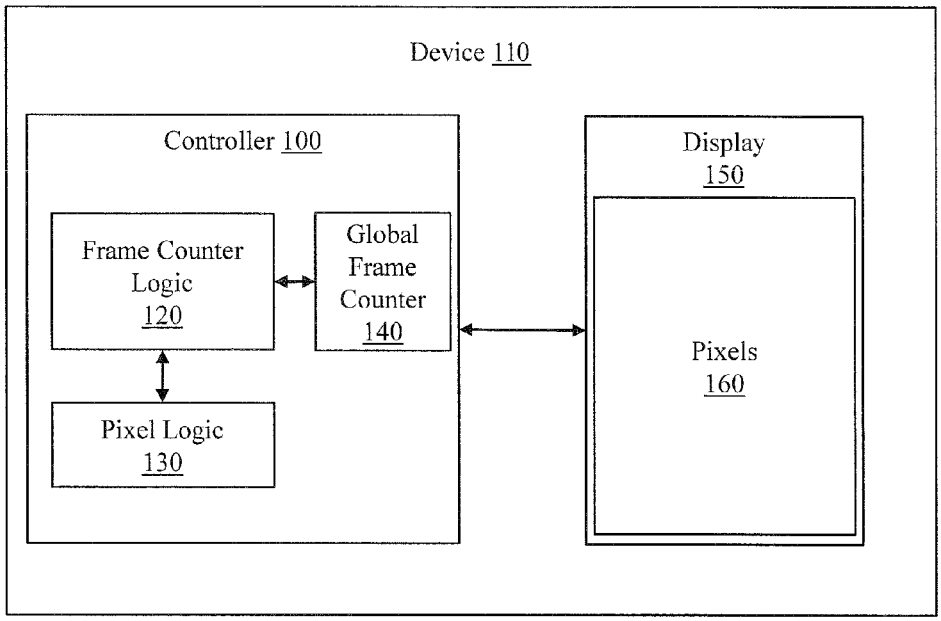
FIG. 1 illustrates one embodiment of a controller associated with independently updating pixels in a display.

With reference to FIG. 1, one embodiment of a controller 100 is shown that is associated with updating pixels in a display. Controller 100 may be implemented on a chip including one or more integrated circuits configured to perform one or more of the functions described herein or may be implemented in firmware, or both. Controller 100 includes a frame counter logic 120, a pixel logic 130, and global frame counter 140. While global frame counter 140 is pictured as being part of the controller 100, in other embodiments, the global frame counter 140 may be located outside of the controller 100.

The controller 100 may be implemented as part of a device 110. Device 110 is, for example, an electronic reading device, a personal digital assistant (PDA), a mobile device, a digital book, a watch, a clock, an embedded label, and so on. Device 110 includes a display 150 configured with pixels 160. In one embodiment, display 150 is an electronic paper display. The electronic paper display uses electrophoretic technology to display images. Thus, pixels 160 may be electrophoretic capsules, in one embodiment. Pixels 160 may be color pixels or grayscale pixels. In one example, a pixel in display 150 is capable of displaying 256 different values. Pixels 160 may be configured to display more or less values depending on the implementation and desired level of resolution.

Controller 100 is configured to independently update the pixels 160 in the display 150. In one embodiment, independently updating pixels 160 refers to the ability to update one pixel without updating the entire display 150 of pixels 160. Independently updating the pixels 160 may also refer to initiating the update of one pixel after another pixel is already being updated or without causing an update of the display 150 including all of the pixels 160. Independently updating pixels is discussed in greater detail with reference to FIGS. 3 and 4.

For purposes of this discussion, suppose the device 110 is an electronic reading device and that display 150 is an electronic paper display with a refresh rate of 50 Hz. Further consider that pixels 160 are configured to display 256 different values in grayscale. Furthermore, controller 100 will be discussed in the context of receiving a request to update one or more pixels 160 in display 150 from an original value to a new value. The request to update a pixel may be a request from a graphics controller or other subsystem in device 110.

To update a pixel, the controller 100 progressively changes the value displayed by the pixel from the original value to the new value. For example, when the original value of the pixel is "223" and the new value is to be "99" controller 100 is configured to progressively change the value of the pixel until the value equals the new value "99". Progressively changing the value in this way may take the form of incremental steps, which in this example would be 124 incremental steps to reach the new value, "99". These incremental steps occur with the refresh of the display. Thus, to change the pixel by 124 incremental steps would use 124 refreshes of the display. In this example, where the refresh rate is 50 Hz, the update of the pixel would take 2.48 seconds. In other examples, the pixel may change multiple values with a refresh of the display or may be restarted at an initial value and then changed to the new value in an incremental manner.

In this embodiment, the frame counter logic 120 is configured to maintain a global frame counter 140. The frame counter logic 120 maintains the global frame counter 140 by incrementing the global frame counter 140 when the display 150 refreshes. Global frame counter 140 is used to determine the progress of an update of a pixel. The global frame counter 140 serves as a reference to determine a current incremental stage in the update progress for the pixel. The incremental stages in the update correlate to a frame number that may be determined from the global frame counter 140. In this manner, the pixel may be properly updated through a sequence of values until reaching the new value as specified in the request to update. Thus, while one or more pixels 160 in the display 150 are being updated, the global frame counter 140 is incremented when the display 150 refreshes (e.g., counter is incremented at each refresh cycle) thereby providing a reference for the sequence of values. Once pixels 160 in the display 150 are no longer being updated, the display will not be refreshed and the global frame counter 140 can be paused until an update of one or more pixels 160 is once again initiated.

If the display 150 has a refresh rate of 50 Hz, the value of the global frame counter 140 is incremented every 1/50 seconds while the controller 100 is updating a pixel. Since a pixel, in this example, is capable of displaying 256 different values, the global frame counter 140 is configured as an 8 bit counter to account for the full range of values for a pixel. When the global frame counter 140 reaches the maximum value of 255 (e.g., "11111111" for an 8 bit counter) it will loopback to a starting value (e.g., 00000000). Accordingly, the frame counter logic 120 may adapt the calculation of the frame number by checking whether the current value of the global frame counter 140 is less than the initial value of the global frame counter 140 from when an update of a pixel was initiated. If this condition is true, then the value (e.g., 256 or $2^N$, where N is the number of bits in the counter) is added to the current value of the global frame counter 140 prior to determining the frame number during an update sequence of a pixel (e.g. Frame Number=(Current value of Global Frame Counter+256)−Initial Value of Global Frame Counter).

In other embodiments, the global frame counter 140 may continue to increment even though the controller 100 is not updating any pixels 160. In this example, the global frame counter 140 may be part of a system clock or other timer that continually tracks time.

In one embodiment, the frame counter logic 120 is also configured to determine a frame number when updating a pixel. The frame number represents a current incremental step for updating a pixel between an original value and a new value. Using the frame number controller 100 can identify an intermediate value for incrementally adjusting the pixel to the new value. Frame counter logic 120 determines the frame number by adjusting a current value of the global frame counter 140 by an initial value of the global frame counter 140. The current value of the global frame counter 140 is, for example, a value of the global frame counter that continuously changes when the display 150 refreshes, which for a 50 Hz refresh rate is once every 1/50 seconds. The initial value is the value of the global frame counter 140 when an update request is received to update the pixel from an original value to a new value. The initial value is written to a memory in the device 110 when the request is received. Thus, the initial value is also a current value at the time when the update request is received. As the update process performs, the current value will incrementally change while the initial value stays the same.

In the present example, the frame counter logic 120 adjusts the current value of the global frame counter 140 to determine the frame number. This may include subtracting the initial value from the current value of the global frame counter 140. When performing this calculation, the frame counter logic 120 reads the initial value of the global frame counter 140 from memory. The frame counter logic 120 then calculates the frame number and passes the frame number to the pixel logic 130 to continue with the update. The frame number is not written back to memory once calculated. In this manner, the frame number is determined using the global frame counter 140 without using memory bandwidth to perform a write-back operation for each incremental step.

The pixel logic 130 drives values to the pixels 160 in the display 150 based on the frame number. In one example, the pixel logic 130 is configured to incrementally adjust the value of a selected pixel by progressively changing the value from its original pixel value to a new pixel value as specified in an update request. Pixel logic 130 iteratively performs the value adjustment until the value of the pixel is equal to the new value. For each refresh of the display 150, the frame counter logic 120 provides a new frame number to the pixel logic 130. The pixel logic 130 uses at least the frame number to determine an intermediate pixel value when incrementally adjusting the value of the pixel.

In one embodiment, the pixel logic 130 determines a value to drive to the display 150 to change the pixel by performing a lookup in a lookup table using the frame number, the new value of the pixel, and the original/initial value of the pixel as input. The lookup table stores voltage values corresponding to sets of initial pixel value, new pixel value and frame number. In one example, the lookup table returns a voltage to be applied to the pixel in the display 150 to progress the value of the pixel by an incremental step in updating the pixel value to the new value.

Consider an example of a conventional display that uses individual counters for pixels against an embodiment that uses a global frame counter as described in FIG. 1. First, consider a display with a screen resolution of 1600×1200 pixels that is capable of displaying 256 ($2^8$) different values for a pixel (8 bits per pixel) and has a refresh rate of 50 Hz. Conventionally, updating the display may consume 183 Mbyte/sec, since there are 1200×1600 pixels that each consume 8 bits of bandwidth per read and 8 bits of bandwidth per write to memory and these write operations occur for each refresh of the display ((8+8)*50*1600*1200=1536000000 bits/sec=192000000 bytes/sec=183 Megabytes/sec). However, using the present global frame counter 140 reduces the memory bandwidth used since there is only one write to memory at the beginning of the update sequence. Thus this results in an update that may consume 93 Mbyte/sec, which amounts to a savings of 90 Mbytes/sec ((8*50+8)*1600*1200=783360000 bits/sec=97920000 bytes/sec=93 Megabytes/sec). Accordingly, the global frame counter 140 reduces use of memory bandwidth by nearly 50% in this example.

Figure 2:
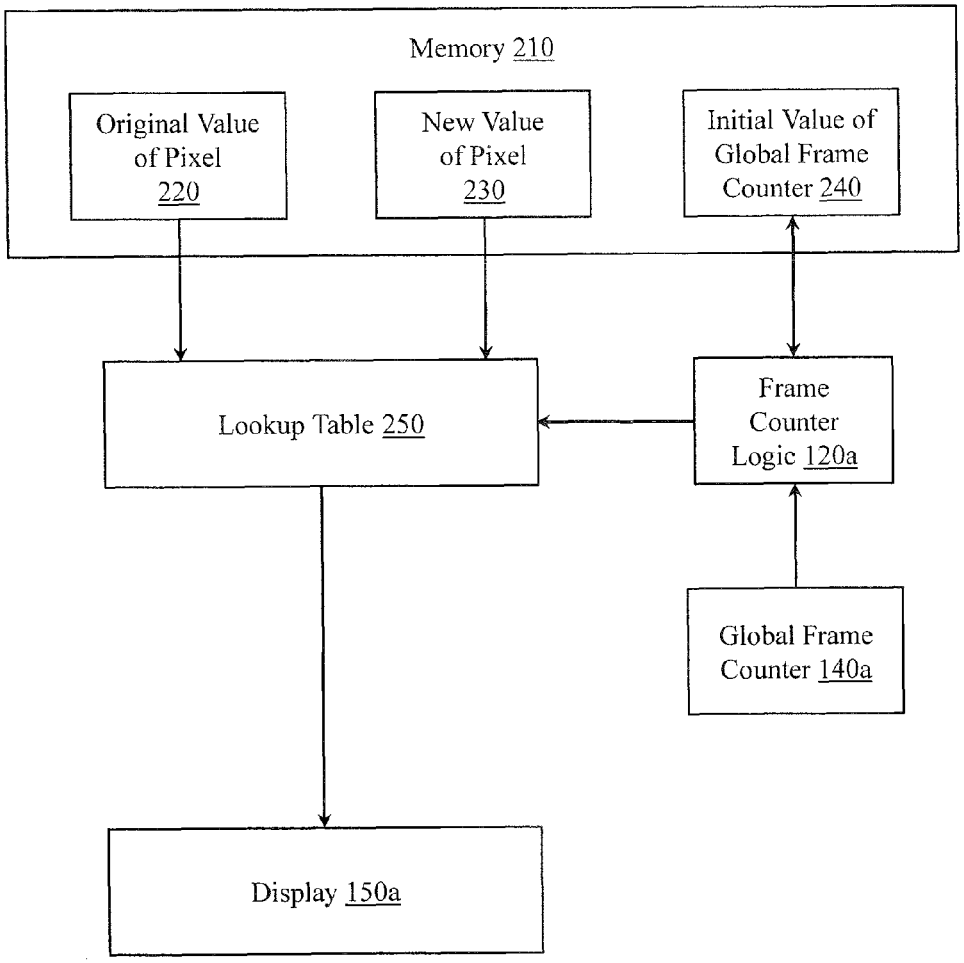
FIG. 2 illustrates a different embodiment of a frame counter logic associated with the controller of FIG. 1.

FIG. 2 illustrates another implementation of a controller associated with independently updating pixels that includes the frame counter logic 120 of FIG. 1. FIG. 2 also includes the global frame counter 140 and display 150 of FIG. 1. In this embodiment, memory 210 is illustrated as storing an initial value 220 of a pixel, a new value 230 of the pixel, and an initial value 240 of the global frame counter 140*a*. The initial value 220 of the pixel and the new value 230 of the pixel are used as an input to a lookup table 250 along with an incremental frame number determined by frame counter logic 120*a*. In response to receiving these three values, the lookup table 250 provides an intermediate pixel value to drive the pixel in the display 150*a*. In one embodiment, the lookup table 250 provides the intermediate value directly to the display 150*a*. In alternative embodiments, the lookup table 250 is part of the pixel logic 130 of FIG. 1 and the pixel logic 130 in cooperation with the controller 100 provides the intermediate value to the display 150.

Figure 3:
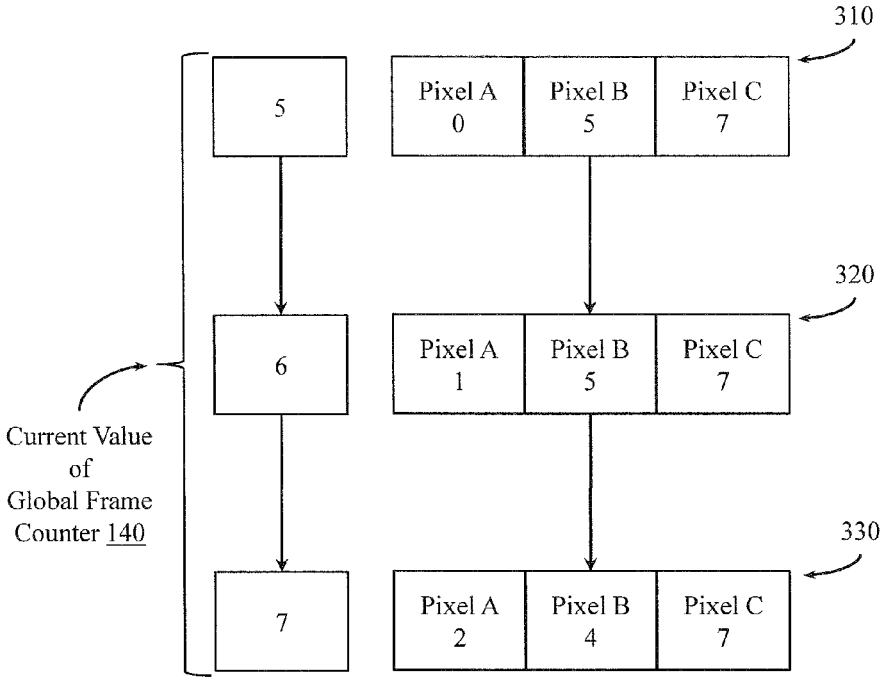
FIG. 3 illustrates three adjacent pixels and an example of a sequence of steps for updating the pixels.

FIG. 3 illustrates one example of a sequence of steps for independently updating pixels. The sequence of steps illustrated in FIG. 3 will be discussed along with elements from FIG. 2. An example of three adjacent pixels A, B, and C are illustrated in FIG. 3 at three sequential steps in time 310, 320, and 330. At time 310, pixel A has an original value of "0", pixel B has an original value of "5", and pixel C has an original value of "7". The values of the pixels may represent a color (e.g., gray, red, yellow, blue) or degree of color (e.g., grayscale) that the pixel displays.

Suppose that a request to update pixel A to a new value "2" is received at time 310 and assume that the value of the global frame counter 140 is "5" at this point. Thus, the value "5" is stored in memory 210 as the initial value 240. The new value "2" is stored in memory 210 as the new value 230 and the present value "0" of pixel A is stored in memory 210 as the original pixel value 220. Concurrently, the frame counter logic 120 determines the incremental frame number and provides the value to the lookup table 250. The original pixel value 220 and the new value 230 are also provided to the lookup table at this time. The lookup table 250 provides the result of the lookup using the three values as input. The resulting value is the intermediate value that is driven to pixel A. This intermediate value is reflected in the value of pixel A when the display 150 refreshes at time 320, which is a value "1".

Global frame counter 140 is incremented when transitioning from time 310 to 320 as a function of the refresh of display 150. Thus, as a result of the refresh, the value of the global frame counter 140 changes to "6" (e.g., incremented once from 5). At time 320, the values of pixels B and C are unchanged. This is one example of how pixels are independently updated (e.g., the value of one pixel changes without affecting other pixels). Frame counter logic 120 continues the update of pixel A by determining the next frame number to provide to the lookup table 250 as input. Thus, frame counter logic 120 reads the initial value 240 from memory 210 and adjusts the current value "6" of global frame counter 240 based on the initial value 140 to obtain the next frame number. In this example, the frame counter logic 120 subtracts the initial value 240 "5" from the current value "6" of the global frame counter 140. This calculation provides a frame number of "1" that the frame counter logic 120 then provides to the lookup table 250 to determine an intermediate value to drive to the display 150 for pixel A.

Additionally, at time 320, suppose a request is received to update pixel B to a new value "1". Thus, the steps discussed above in relation to pixel A at time 310 will occur similarly for pixel B except the memory values 220, 230, and 240 are stored as different values (not illustrated in FIG. 2) in the memory 210 to prevent overwriting of values for pixel A.

At time 330, the result of incremental updating pixels A and B are reflected in the displayed values of pixels A and B. The update of pixel A is complete since the current value "2" equals the new value "2" from the request to update. Pixel B has been changed to "4" as it continues to incrementally change towards its requested value of "1" in additional incremental steps (not shown). Pixel C remains unchanged since no update for pixel C is occurring. The update of pixel B while pixel A is concurrently being updated (and while other pixels are not updated) is an example of how pixels 160 are independently updated in the display 150 using the controller 100 of FIG. 1. In prior systems, the update to pixel B would not begin until pixel A finished being updated at time 330. Additionally, the memory bandwidth savings realized by using the global frame counter 140 is demonstrated at time 320 when determining the frame number for pixel A. At 320, no value is written-back to memory 210 for pixel A. Instead, the frame number is determined using the current value of global frame counter 140 and by reading the initial value 240 from memory 210.

Figure 4:
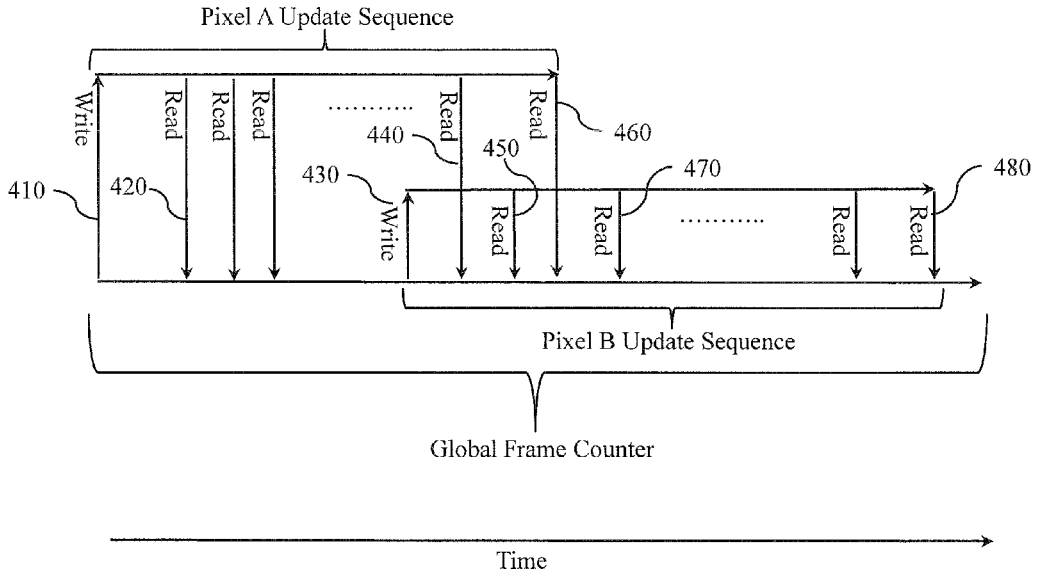
FIG. 4 illustrates an example of a timing diagram associated with updating two pixels in a display.

FIG. 4 illustrates an example of a timing diagram associated with updating two pixels, such as pixels A and B of FIG. 3. FIG. 4 shows a more detailed memory timing sequence for independently updating the two pixels in a display. The update sequences for pixels A and B, as illustrated in FIG. 4, partially overlap but begin and end at different times of the global frame counter. As illustrated, the update of pixel B begins after the update of pixel A initiates, which demonstrates one way in which two different pixels are updated independently of each other.

At 410, pixel A's update sequence begins by writing the initial value of the global frame counter to memory. The memory write at 410 is similar to that discussed with pixel A in FIG. 3 at 310. The global frame counter is incremented by one step between 410 and 420. Additionally, an intermediate value for pixel A is driven to the display with a refresh that occurs in the transition between 410 and 420.

At 420, the initial value of the global frame counter that was written to memory at 410 is read from memory and an incremental frame number for pixel A is determined. The incremental frame number read at 420 is used to determine an intermediate value in pixel A's update sequence that is driven to the display. The update sequence for pixel A progresses in this manner with iterative reads from memory of the initial value of the global frame counter value until pixel A is updated to the new value. While the update sequence continues for pixel A, the global frame counter continues to update, and a request to update pixel B is received. At 430, the pixel B update sequence begins where the initial value for the global frame counter is written to memory (e.g., "write" action). The initial value equals the value of the global frame counter at the time when the request to update pixel B is received. The steps associated with 430 and pixel B are similar to those of pixel A at 410. Additionally, the memory write at 430 for pixel B occurs along with a memory read for pixel A during the update sequence of pixel A.

At 440, the update sequence for pixel A continues concurrently as the update sequence for pixel B is progressing. The memory read events for pixels A and B at 440 and 450, respectively; occur at substantially the same time. Incremental frame numbers determined for pixel A and pixel B at this point will differ since the initial values of the global frame counter for pixels A and B are different due to their respective update sequences beginning at different times. The intermediate pixel values for the incremental frames of pixels A and B at 440 and 450 will be driven to the display screen in the same refresh cycle of the display.

Memory read 460 and 470 also occur at substantially the same time with the intermediate values of the pixels being driven to the display at the same refresh. However after read 460, the final incremental adjustment for pixel A is complete and the update sequence for pixel A terminates. The update sequence for pixel B continues until 480 when the new value is displayed. It should be understood that FIG. 4 illustrates an overlapping update of two pixels A and B. However, more or less pixels may be updated at the same time or overlap in a similar manner as pixels A and B.

Figure 5:
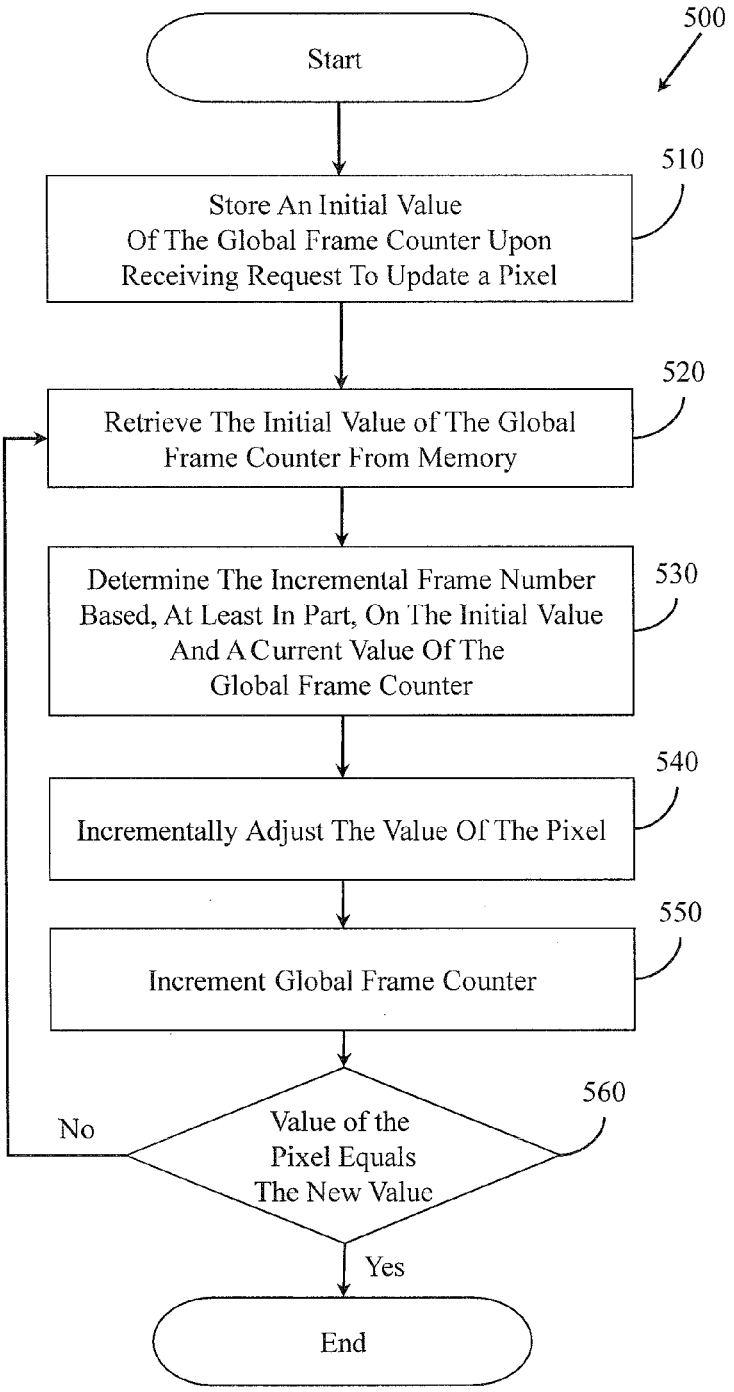
FIG. 5 illustrates one embodiment of a method associated with updating pixels in an electronic display using a global frame counter.

FIG. 5 illustrates one embodiment of a method 500 associated with independently updating pixels in an electronic display using a global frame counter. Method 500 may be implemented, for example, in controller 100 of FIG. 1. Method 500 will be discussed in the context of updating a single pixel in a display. However, method 500 is not limited to updating one pixel at a time. In various embodiments, method 500 may be a threaded process that occurs in parallel with multiple instances that are also updating other pixels in the display. Additionally, separate pixels may be updated concurrently and/or sequentially and may begin and/or end during the update of other pixels.

At 510, method 500 begins by storing an initial value of the global frame counter in a memory. In one embodiment, storing the initial value occurs in response to receiving a request to update the pixel to a new value. In this manner, an association to when the request to update the pixel was received is saved for later reference. When the display refreshes the global frame counter increases in value, thus, an elapsed number of frames is determined by referring back to the start time previously stored in memory.

At 520, a memory read occurs to retrieve the initial value of the global frame counter that was written to memory at 510. In one embodiment, a first iteration of the read at 520 may be skipped since the initial value is the same as the current value of the global frame counter at this time. Thus, for the initial iteration, method 500 may proceed from 510 to 530, in one embodiment.

At 530, method 500 determines the incremental frame number. The incremental frame number is used to identify an intermediate value in a series of values for incrementally adjusting the pixel to the new value. An incremental adjustment of the pixel occurs with each refresh of the screen. Accordingly, the incremental frame number is related to the number of refreshes for the display since receiving the request to update the pixel. The incremental frame number is determined from a current value of a global frame counter and the initial value of the global frame counter. In one example, the incremental frame number is determined by subtracting the initial value of the global frame counter from the current value of the global frame counter. In alternative embodiments, the global frame counter is a clock and not a simple counter. Thus, the initial value and the current value of the global frame counter may be processed by an algorithm that provides the incremental frame number as an output. This approach may be applied where the initial value is a start time and the current value is a present time. In this case, the values would be adjusted for the refresh rate to determine the incremental frame number.

Figure 6:
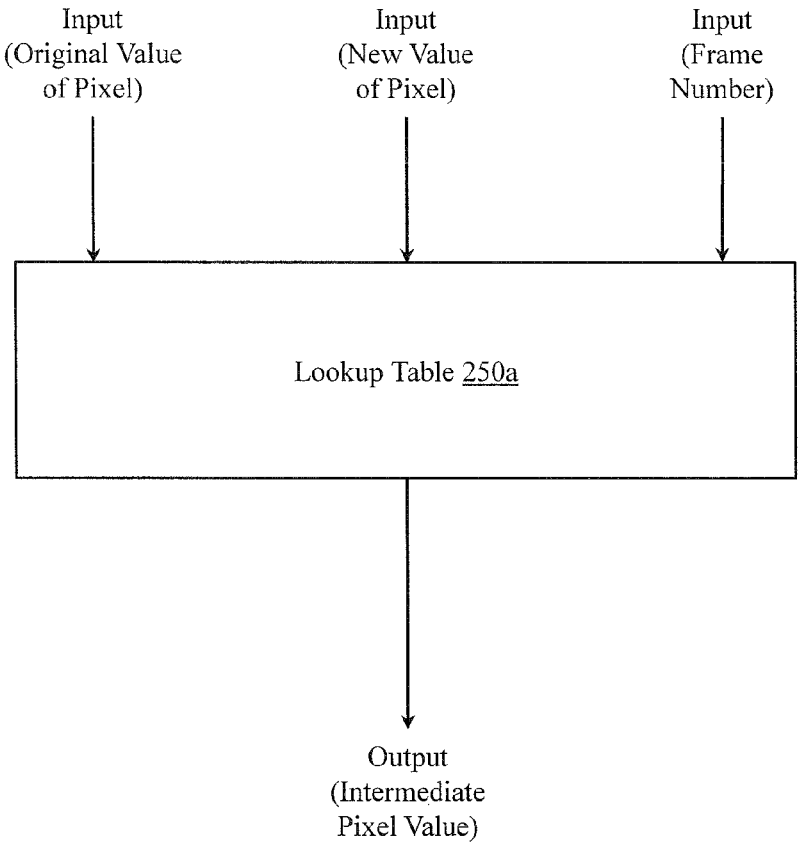
FIG. 6 illustrates one embodiment of the lookup table of FIG. 2.

At 540, the pixel is incrementally adjusted by applying an intermediate pixel value to the display. The intermediate pixel value is determined by using, at least, the incremental frame number as an input to the lookup table. FIG. 6 illustrates one embodiment of the lookup table 250*a* used to determined the intermediate pixel value of FIG. 2. The look-up table 250*a* includes a listing of intermediate pixel values for updating a pixel based on various combinations of input values. In one example, the look-up table 250*a* also uses the original value of the pixel and the new value of the pixel as inputs. By providing the original value and new value as inputs, the polarity/direction of change can be determined. Thus, providing the incremental frame number, the original value, and the new value facilitate determining an intermediate value that will progress the update sequence for the pixel in the correct direction with the correct value. The value that is supplied by the look-up table 250*a* for the intermediate pixel value may be a positive or a negative voltage that causes the pixel to change by a single display value from the current value of the pixel. In this manner, the pixel incrementally progresses through display values between the original value and new value.

In some embodiments, the look-up table 250*a* provides a waveform as the intermediate pixel value. The waveform may be of a specific design to cause the pixel to change in a certain manner. For example, the waveform may be a square waveform or saw-tooth waveform of specific amplitude to change to the pixel value accordingly.

With continued reference to FIG. 5, at 550, the method increments the global frame counter after adjusting the value of the pixel at 540. The global frame counter is, for example, based on a refresh rate for the display. Thus with each refresh of the display, the global frame counter is incremented. In this manner, the global frame counter tracks how many times the display refreshes and can be used to determine which frame in an update sequence is currently being displayed. In alternative embodiments, the global frame counter is a clock and is not incremented with the refresh of the display. Instead, the global frame counter operates as a standard clock but with enough precision in order to effectively determine the incremental frame number. For example, if the refresh rate for the display is 50 Hz then a refresh of the display occurs every 0.02 seconds. Accordingly with a global frame counter that is precise to at least 0.01 seconds, an accurate count of display refreshes may be made when the refresh rate is 50 Hz.

At 560, the method proceeds by determining whether the pixel equals the new value. Actions at 520 to 560 are performed iteratively for each refresh of the display until the value of the pixel is equal to the new value that was provided in the original request to update.

The following includes definitions of selected terms employed herein. The definitions include various examples and/or forms of components that fall within the scope of a term and that may be used for implementation. The examples are not intended to be limiting. Both singular and plural forms of terms may be within the definitions.

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

"Logic", as used herein, includes but is not limited to hardware, firmware, instructions stored on a non-transitory medium or in execution on a machine, and/or combinations of each to perform a function(s) or an action(s), and/or to cause a function or action from another logic, method, and/or system. Logic may include a software controlled microprocessor, a discrete logic (e.g., ASIC), an analog circuit, a digital circuit, a programmed logic device, a memory device containing instructions, and so on. Logic may include one or more gates, combinations of gates, or other circuit components. Where multiple logics are described, it may be possible to incorporate the multiple logics into one physical logic. Similarly, where a single logic is described, it may be possible to distribute that single logic between multiple physical logics. One or more of the components and functions described herein may be implemented using one or more of the logic elements.

While for purposes of simplicity of explanation, illustrated methodologies are shown and described as a series of blocks. The methodologies are not limited by the order of the blocks as some blocks can occur in different orders and/or concurrently with other blocks from that shown and described. Moreover, less than all the illustrated blocks may be used to implement an example methodology. Blocks may be combined or separated into multiple components. Furthermore, additional and/or alternative methodologies can employ additional, not illustrated blocks.

To the extent that the term "includes" or "including" is employed in the detailed description or the claims, it is intended to be inclusive in a manner similar to the term "comprising" as that term is interpreted when employed as a transitional word in a claim.

While example methods, apparatus, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the disclosure is not limited to the specific details, the representative apparatus, and illustrative examples shown and described. Thus, this application is intended to embrace alterations, modifications, and variations that fall within the scope of the appended claims.

What is claimed is:

1. An apparatus, comprising:

a frame counter logic configured to:

maintain a global frame counter to track a number of refreshes of a display while updating pixels, wherein the frame counter logic is configured to operate the global frame counter by continuously counting with each refresh of the display and to loopback the global frame counter when a value of the global frame counter reaches a maximum value that is set to be equal to a total number of possible values for a pixel in the display; and determine a frame number when updating a pixel, wherein the frame number is based on a current value of the global frame counter and an initial value of the global frame counter, and wherein the frame counter logic is configured to determine the frame number without writing the frame number to a memory after each of the number of refreshes; and a pixel logic configured to update a value of the pixel based, at least in part, on the frame number for the current value of the global frame counter until the value of the pixel is equal to a new value, wherein the initial value is a value of the global frame counter when a request is received to update the value of the pixel to the new value, wherein the frame counter logic is configured to maintain the global frame counter independently of whether a pixel is currently being updated by continuously updating the global frame counter at a refresh rate of the display, wherein the maximum value of the global frame counter is a maximum number of values for a pixel update sequence, wherein the frame counter logic is configured to reset the global frame counter after the global frame counter reaches the maximum value, wherein the pixel logic is further configured to provide the frame number, the initial value of the pixel and the new value as input to a lookup table to retrieve an incremental value to update the value of the pixel for each incremental update of the pixel, and wherein the incremental value is a waveform for incrementally changing the value of the pixel according to the frame number, the initial value and the new value.

2. The apparatus of claim 1, wherein the frame counter logic is further configured to store the initial value of the global frame counter upon receiving the request to update the value of the pixel to the new value and to read the initial value of the global frame counter from a memory prior to determining the frame number, and wherein the frame number identifies an intermediate value for incrementally adjusting the value of the pixel to the new value.

3. The apparatus of claim 1, wherein the waveform provided in response to the frame number, the initial value and the new value has a polarity and configuration to cause the value of the pixel to incrementally change to achieve the new value.

4. The apparatus of claim 1, wherein the pixel logic is further configured to incrementally adjust the value of the pixel by progressively changing the value of the pixel from an initial value to the new value based, at least in part, on the global frame counter, wherein the new value is received in the request to update the pixel and wherein the frame logic is configured to operate the global frame counter continuously when pixels are being updated and when pixels are not being updated.

5. The apparatus of claim 1, wherein the global frame counter is a timer that is incremented once per refresh of the display.

6. A method, comprising:

updating a value of a pixel of a display to a new value by:

determining an incremental frame number from a current value of a global frame counter; and adjusting the value of the pixel based, at least in part, on the incremental frame number, wherein the value of the pixel is updated without performing a write-back of the incremental frame number to a memory; and maintaining the global frame counter independently of whether a pixel is currently being updated by continuously updating the global frame counter at a refresh rate of the display, wherein a maximum value of the global frame counter is a maximum number of values for a pixel update sequence, wherein maintaining the global frame counter includes resetting the global frame counter after the global frame counter reaches the maximum value, wherein maintaining the global frame counter includes continuously counting with each refresh of the display and looping back the global frame counter when a value of the global frame counter reaches the maximum value that is set to be equal to a total number of possible values for a pixel in the display, wherein incrementally adjusting the value of the pixel includes retrieving an incremental pixel value from a lookup table for each incremental update of the pixel using the incremental frame number, an initial value of the pixel and the new value as input to the lookup table, and applying the incremental pixel value to the pixel in the display, and wherein the incremental pixel value is a waveform for incrementally changing the value of the pixel according to the incremental frame number, the initial value and the new value.

7. The method of claim 6, further comprising:

storing an initial value of the global frame counter in a memory, wherein storing the initial value occurs upon receiving a request to update the value of the pixel to the new value.

8. The method of claim 6, wherein determining the incremental frame number includes manipulating the current value of the global frame counter based, at least in part, on an initial value of the global frame counter.

9. The method of claim 6, wherein determining the incremental frame number and incrementally adjusting the value of the pixel occurs iteratively until the value of the pixel equals the new value.

10. The method of claim 6, wherein adjusting the value of the pixel occurs until the value of the pixel equals the new value, and wherein the incremental frame number identifies an intermediate value in a series of values for incrementally adjusting the value of the pixel to the new value.

11. The method of claim 6, wherein the waveform provided by the lookup table has a polarity and configuration to cause the value of the pixel to incrementally change to achieve the new value.

12. An apparatus, comprising:

a display controller configured to update a pixel in an electronic paper display by:

storing, in a memory, an indication of a start time for a request to update the pixel;

determining an incremental frame number by determining a number of refreshes for the electronic paper display since receiving the request to update the pixel to a new value; and adjusting a value of the pixel based, at least in part, on the incremental frame number, wherein the display controller is further configured to determine the number of refreshes by retrieving the indication of the start time from the memory and adjusting a current time based, at least in part, on the start time, and wherein the current time is based, at least in part, on a refresh rate of the display;

frame counter logic configured to maintain the current time using a global frame counter independently of whether a pixel is currently being updated by continuously updating the global frame counter at a refresh rate of the electronic paper display, wherein a maximum value of the global frame counter is a maximum number of values for a pixel update sequence, and wherein the frame counter logic is configured to reset the global frame counter after the global frame counter reaches the maximum value, wherein the frame counter logic is configured to operate the global frame counter by continuously counting with each refresh of the display and to loopback the global frame counter when a value of the global frame counter reaches the maximum value that is set to be equal to a total number of possible values for a pixel in the display; and a lookup table, wherein the display controller is configured to incrementally adjust the value of the pixel based, at least in part, on the incremental frame number and uses the incremental frame number, an initial value of the pixel and the new value as input to the lookup table to determine the intermediate value from the lookup table for each incremental update of the pixel, wherein the intermediate value is a waveform for incrementally changing the value of the pixel according to the frame number, the initial value and the new value.

13. The apparatus of claim 12, wherein the display controller is further configured to update the pixel by iteratively:

determining the incremental frame number and incrementally adjusting the value of the pixel until the value of the pixel equals the new value.

14. The apparatus of claim 12, wherein the incremental frame number identifies an intermediate value in a series of values for incrementally adjusting the value of the pixel.

15. The apparatus of claim 12, wherein the waveform provided in response to the frame number, the initial value and the new value has a polarity and configuration to cause the value of the pixel to incrementally change to achieve the new value.

* * * * *